United States Patent [19]

Chaffers

[11] 3,946,934

[45] Mar. 30, 1976

[54] MULTI-PLY PANEL WITH STACKING TAB

[75] Inventor: John Michael Chaffers, Longview, Wash.

[73] Assignee: Weyerhaeuser Company, Tacoma, Wash.

[22] Filed: Jan. 2, 1975

[21] Appl. No.: 537,972

[52] U.S. Cl. ..... 229/23 R; 229/DIG. 11

[51] Int. Cl.[2] ..... B65D 13/00

[58] Field of Search .... 229/23 R, 44 R, 45 R, 34 R, 229/DIG. 11

[56] References Cited

UNITED STATES PATENTS

| | | | |
|---|---|---|---|
| 2,893,621 | 7/1959 | Harnish et al. | 229/DIG. 11 |
| 3,713,579 | 1/1973 | Chaffers | 229/DIG. 11 |
| 3,757,935 | 9/1973 | Coons et al. | 229/23 R |
| 3,788,538 | 1/1974 | Kuenzi | 229/23 R |
| 3,814,302 | 6/1974 | Coons et al. | 229/23 R |

*Primary Examiner*—Davis T. Moorhead

[57] ABSTRACT

A wall panel for a containerboard box is erected from a single piece blank into a four-ply, high-strength wall having an integral stacking tab extending upwardly from the top edge.

5 Claims, 5 Drawing Figures

MULTI-PLY PANEL WITH STACKING TAB

BACKGROUND OF THE INVENTION

This invention relates generally to wall panels that may be utilized in multiple piece containers constructed of containerboard. More particularly, the invention relates to a particular design for a wall panel that is comprised of a single piece of containerboard that is cut and scored appropriately so as to fold into a multi-ply panel having an integral stacking tab extending upwardly from the top edge.

In the shipping container art there are many designs that are manufactured for various end uses. One of the more common styles is that generally known as the "Bliss" box where multi-ply end panels are provided together with bottom and side walls in order to form a strong container having good stacking strength. The assignee of the present invention is one such manufacturer of Bliss style containers. An example of machinery that can be utilized to form Bliss style containers may be seen by referring to U.S. Pat. Nos. 3,541,930 and 3,673,928, both assigned to the assignee of the present invention. Also disclosed in the above referenced patents is the structure of a typical Bliss style container.

One problem with prior Bliss style containers has been their lack of stacking strength and a conveniently formed stacking tab. Of course, it is a simple matter to laminate several pieces of containerboard together to form additional stacking strength, but such a design does not provide for a stacking tab in a convenient manner. Ideally, a multi-ply wall panel, together with a stacking tab should be formed from a single piece of containerboard and also have the capability of either being machine formed or hand formed, depending on the requirements.

Accordingly, one object of the present invention is to provide a wall panel that has increased stacking strength. Another object is to provide a wall panel for a container that has an integral stacking tab. Yet a further object of the present invention is to provide a single piece blank that can be erected to provide both multiple plies, together with the integral stacking tab in wall panel form.

These and other objects of the invention will become apparent upon reading the following specification in conjunction with the attached drawing.

SUMMARY OF THE INVENTION

Briefly, this invention is practiced in one form by cutting and scoring a single piece of containerboard such that it can be first folded approximately in half and then secondly, again approximately in half so as to form on the second folding a four-ply wall panel having a stacking tab extending upwardly from the top edge which will extend through an aperture that is positioned appropriately within the containerboard. If desired, appropriate amounts of adhesive can be applied to juxtaposed services of the folded panels in order to give it additional stacking strength. After the wall panel is erected, it may be then utilized in forming a typical Bliss style container.

DESCRIPTION OF THE PREFERRED EMBODIMENT

Figure 1:
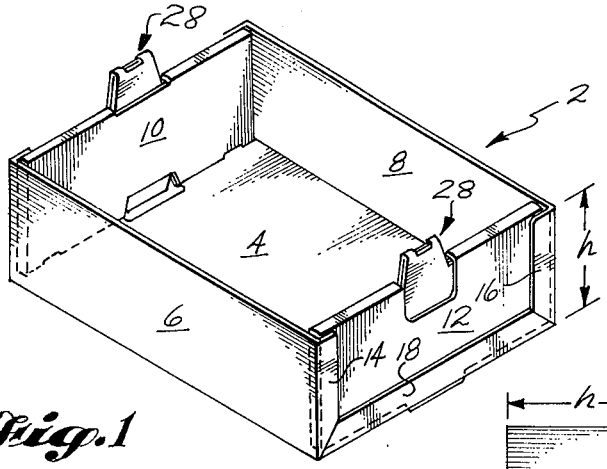
FIG. 1 is an isometric view showing a typical Bliss style container which utilizes as its two end panels the present invention.

Referring now to the drawing in detail, the Bliss style container is generally depicted at 2 in FIG. 1. Typical Bliss style containers are comprised of three pieces which form the body that can be complemented by any suitable closure means (not shown). The main portion of container 2 is comprised of a bottom panel 4 and two side panels 6 and 8 respectively. Forming the end panels of the Bliss style container 2 are the wall panels 10 and 12 that comprise the present invention. Panels 10, 12 are designated as wall panels since it is not absolutely necessary that they form the ends of the containers, but rather they could form the side walls as well. Securing the wall panels 10, 12 to the bottom and side panels of container 2 are the overlapping edges 14, 16 of the side panels as well as the overlapping edge 18 of bottom panel 4. The overlapping edges are, as will be recognized by those skilled in the art, bonded to the wall panels 10, 12 in order to form the finally erected Bliss style container 2.

Figure 2:
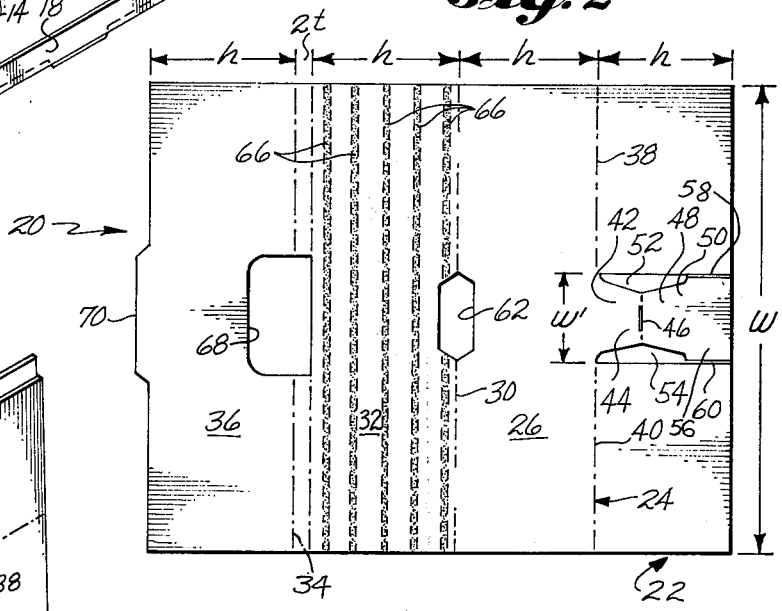
FIG. 2 is a plan view showing the single piece wall panel blank with the appropriate score lines and cutouts.

Turning now to FIG. 2 and a description of the wall panel that forms the substance of the present invention, a single piece blank is generally depicted at 20. Single piece blank 20 would normally be comprised of typical containerboard material that is readily folded and workable. In FIG. 2, the longer dimension of blank 20 is actually that dimension which will be reduced to form the final height *h* of wall panels 10, 12 while the shorter dimension of FIG. 2 is that which will form the width *w* of wall panels 10, 12. The longer dimension of blank 20 is sized so that it could be folded four times with the final dimension being that equal to the height *h*.

The single piece blank 20 is divided into four essentially equal dimensioned panels with at least one score line dividing one panel from another. The tab or first interior panel 22 is the one forming the far right hand panel in FIG. 2 and separated from it by interrupted score line 24 is the second interior panel 26 which has at the interrupted portion one edge of the overall stacking tab which is indicated generally at 28 in the several figures. Separated from the second interior panel 26 through a single score line 30 is the first outer panel 32 and separated from outer panel 32 through a double score line, indicated at 34, is the second outer panel 36. The double score line 34 is dimensioned on FIG. 2 by the 2*t* designation, meaning that the two score lines are arranged so as to allow the first and second outer panels 32 and 36 to accommodate two thicknesses of containerboard between them after folding.

Turning back now to a description of each individual panel comprising the overall single piece blank 20, it will be noted that the score line 24 separating the first interior panel 22 from the second interior panel 26 does not extend the full width of blank 20. Rather, the score line 24 is comprised of two separate portions 38, 40 separated by an unscored portion of containerboard that, in the erected condition, becomes one side of the base for stacking tab 28. The first base portion of stacking tab 28 is indicated as 42 on FIG. 2 and generally comprises a portion of containerboard which is approximately one-eighth to one-third of the width dimension *w* and which is left connected to the second interior panel. In the single piece blank 20 the stacking tab portion is cut from contained entirely within the first interior panel 22. From the base portion 42 extends the tab which terminates in the first top portion indicated as 44. Separated from the first top portion 44 through a single score line 46 is the second top portion 48. The top portion 48 then makes the transition in containerboard material into the second base portion 50. Second base portion 50 has its edge aligned with the bottom edges of the first interior panel 22, although such a structure is not absolutely necessary and the base portion 50 could be extended outwardly. Such an extension would, however, utilize more containerboard and thereby become a more expensive construction.

It will be seen by continuing to refer to FIG. 2 that there are a pair of opposed cutouts 52, 54 positioned within the first interior panel 22 relative to the stacking tab 28 to set the tab out from panel 22. The opposed cutouts 52, 54 are triangularly shaped in order to give an edge to the stacking tab 28 that is slightly inclined from the vertical when in the erected condition. It will be seen that the two apices of the triangles closest to one another terminate at the opposed ends of score line 46. It will also be recognized that the height dimension of the combined first top and base portions 42, 44 is less than the combined dimension of the second top and base portions 48, 50. The second base portion 50 includes an extended portion 56 that is provided so as to offer structural support to the upwardly extending stacking tab 28 when in the erected position. The extended portion 56 is free of the first interior panel 22 as caused by the die-cut lines 58, 60. The width *w'* of the stacking tab 28 at its base is indicated on FIG. 2.

Looking now at the second interior panel 26 and the first outer panel 32, it is seen by referring to FIG. 2 that the score line 30 separating the two panels is interrupted by a cutout portion indicated at 62. The score line 30 will form a part of the bottom edge of the erected wall panel when it is in its erected condition and thus the cutout portion 62 will form a receptacle portion 64 along the bottom edge of wall panels 10, 12 as seen more clearly by referring to FIGS. 3 and 4. The cutout portion 62 is sized, as will be recognized by those skilled in the art, to accept an upwardly extending stacking tab from a container which is positioned beneath another container. Thus the top portions of a stacking tab will extend up and into the receptacle portion 64 of the erected wall panel 10, 12. As depicted in FIG. 2, the first outer panel 32 has a plurality of adhesive lines 66 extending along the width of the blank panel. While adhesives are not absolutely necessary to erect the single piece blank 20 into the completed wall panels 10, 12, adhesive does, of course, provide additional strength and integrity. The lines of adhesive 66 may be applied to the panel 32 just prior to folding and erecting as will be described.

Looking now at the second outer panel 36 separated from the first outer panel 32 by double score line 34, it will first be recognized that a distance represented by *2t* on FIG. 2 separates the two score lines. Positioned within the second outer panel 36 is the stacking tab cutout 68 through which will extend the stacking tab

28. One edge of cutout 68 is colinear with that score line of the double score line 34 which is closer to first outer panel 32. Cutout portion 68 extends in the *h* direction a distance that is at least equal to the vertical dimension of the stacking tab when it is extending upwardly through cutout 68. An elongated tab 70 can be provided along the outer edge of second outer panel 36 which would fit within a cutout portion of the bottom panel 4 after wall panels 10, 12 are in position in Bliss style container 2. Such a tab is not absolutely necessary to the present invention but does provide additional strength and rigidity if desired.

Figure 3:
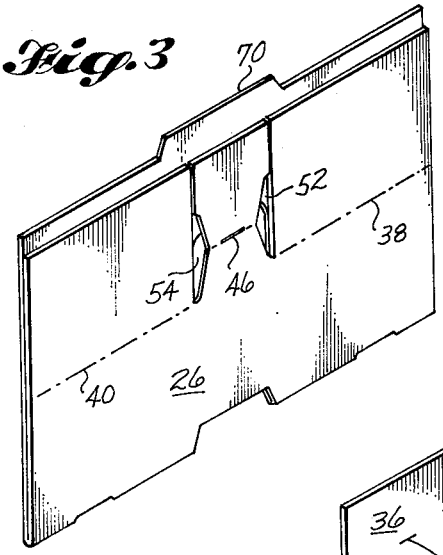
FIG. 3 depicts the first folding step in erecting the finished wall panel.
Figure 4:
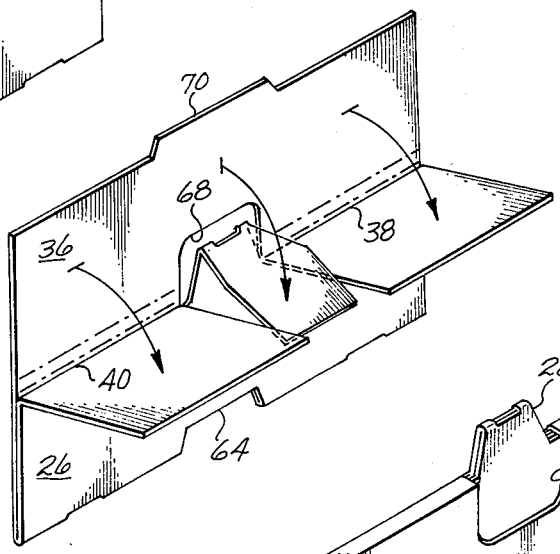
FIG. 4 depicts the subsequent folding step during which the integral stacking tab is formed.
Figure 5:
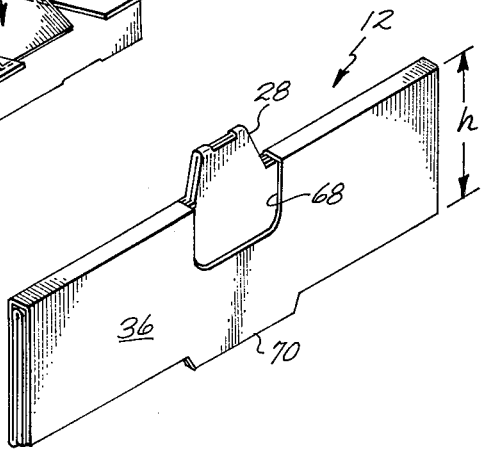
FIG. 5 shows the erected wall panel with the stacking tab extending upwardly from the top edge.

Turning now to FIGS. 3–5, the folding method for erecting the wall panels 10, 12 will be described. The first step is as depicted in FIG. 3 whereby panels 22 and 26 are together folded 180° so as to be juxtaposed against panels 32 and 36. If the lines of adhesive 66 are applied prior to this folding step, the juxtaposed panels 26 and 32 will be bonded together. The next step is as depicted in FIG. 4 and consists of folding the first interior panel 22, 180° so it is now juxtaposed against panel 26. If desired, additional adhesive could be applied to the surface of either panel 22 or panel 26 such that they would be bonded together. At this same time the stacking tab 28 is formed by folding the second top and base portions 48, 50 together with the extended portion 56 over so as to be juxtaposed against the face of the first top and base portions 42, 44 while the extended portion 56 would overlay a part of panel 26. It will also be appreciated that prior to thusly forming the stacking tab 28, adhesive could be so positioned that the two-ply stacking tab would be appropriately strengthened by the adhesive. The final folding step is carried out by bending the second outer panel 36, 180° over through the double score line 32 such that it is juxtaposed against the first interior panel 22. Again, suitable adhesive areas could be applied so that panel 22 would become bonded to panel 36. As panel 36 is folded over, the stacking tab cutout 68 will pass over the upwardly extending stacking tab 28 so as to allow the flat planer construction as depicted in FIG. 5.

The wall panels thusly formed can then be utilized as the end walls in a typical Bliss style container 2. Each wall panel constructed according to the present invention will be an integral multi-ply panel having an upwardly extending stacking tab that offers substantial stacking strength when one container is stacked atop another.

While a detailed example of the principal embodiment has been described, it is understood that further changes and modifications may be made in the above described wall panel without departing from the spirit of the invention. All such modifications are intended to be included within the scope of the appended claims.

What is claimed is:

1. a single piece containerboard blank for forming a multi-ply wall panel having at least one stacking tab extending upwardly from the top edge, comprising:

a tab panel having a substantially rectangular planar shape and a pair of opposed side edges together with top and bottom edges that are interrupted, a second panel having a rectangular shape substantially similar to the tab panel and connected thereto along the top edge by a score line having an interruption therealong generally colinear with the interruption along the top edge of the tab panel, and at least one stacking tab blank positioned within and cut substantially from the planar tab panel, comprising:

a first base portion connected to the second panel and extending outwardly from a line substantially colinear with the score line at the interrupted portion thereof and terminating in a first top portion, and a second top portion connected to the first top portion by a score line and extending outwardly therefrom and terminating in a second base portion, whereby the tab panel can be folded to overlay the second panel while the second top and base portions of the stacking tab blank can be folded to overlay a portion of the second panel.

2. The blank as in claim 1 further including at least one cutout positioned along the bottom edge of the second panel and sized to correspond with the size of a stacking tab.

3. The blank as in claim 1 further including a first outer panel connected to the second panel through a score line and having a rectangular shape substantially similar to the second panel and adapted to overlay the multiply wall panel.

4. The blank as in claim 3 further including a second outer panel connected to the first outer panel through a score line and having a rectangular shape substantially similar to the first outer panel and adapted to overlay the multiply wall panel.

5. The blank as in claim 4 further including a stacking tab cutout positioned within the second outer panel and sized so as to be larger than and in line with the stacking tab blank.

* * * * *